United States Patent [19]

Jang

[11] Patent Number: 4,616,552

[45] Date of Patent: Oct. 14, 1986

[54] JAZZ DRUMHEAD

[76] Inventor: Chan-Hwei Jang, 7, Lane 6, Kuang Ming, Hsi Chuan Li, South Dist., Taichung, Taiwan, 400

[21] Appl. No.: 807,152

[22] Filed: Dec. 10, 1985

[51] Int. Cl.[4] ..... G10D 13/02

[52] U.S. Cl. ..... 84/414

[58] Field of Search ..... 84/411–421

[56] References Cited

U.S. PATENT DOCUMENTS 3,668,296 6/1972 Criscuolo ..... 84/414

4,254,685 3/1981 Rose ..... 84/414

FOREIGN PATENT DOCUMENTS 2113888 8/1983 United Kingdom ..... 84/414

*Primary Examiner*—Lawrence R. Franklin

*Attorney, Agent, or Firm*—Armstrong, Nikaido, Marmelstein & Kubovcik

[57] ABSTRACT

A jazz drumhead characterized by comprising a stepped, curved buffer ring formed by compression moulding and set between the central part and circumferential part of the drumhead to make the central part 1–1.2 mm higher than the circumferential part so as to offer a tolerance of the radial tension of the drumhead to prolong its life, facilitate timbre adjusting and minimize noises.

1 Claim, 2 Drawing Figures

JAZZ DRUMHEAD

BACKGROUND AND SUMMARY OF THE INVENTION

Except of different sizes and types designed and made to meet the requirements in sound scale and volume, the manufacturing process and material of conventional jazz drums are almost the same. In manufacturing such percussion drums, the major technical problem difficult to overcome has so far been to pursue good timbre. The key point which has the greatest effect is the quantity of vibration noises produced when the membrane is beat. Therefore, drum manufacturers have endeavored to improve the material and process of making cylinders, the material of single or double membrane, the material of rim, and the way and angle of cylinder-membrane joint, as well as to make further improvements in tuning devices such as being equipped with a tuner or noise reducer and even adhered with muffler films or the like to the central part of the drumhead in order to reduce the noise and improve the timbre.

However, they still have the following disadvantages:

1. Since there is no buffer zone between the membrane and cylinder, uneven tension will result from the uneven bond of the main and second cylinders and the membrane and it is difficult to adjust to obtain a desired scale.

2. Since the fully flat drumhead has its edge attached to the rim of the cylinder, noises are to be caused during percussion by the technically inevitable dead angle of the joint of the outer edge of the drumhead and the rim of the cylinder and the spread and vibration of sound waves. This is a great defect in timbre.

3. Since the whole drumhead is flat, elastic fatigue will be caused by vibration during percussion and incorrect sound scale will occur, which takes time to adjust and causes trouble to the user.

In view of the above mentioned deficiency of conventional jazz drums, the inventor tried hard to make research and improvements and developed this invention. So the main object of this invention is to provide a jazz drumhead comprising a stepped, curved buffer ring formed by compression moulding and set between the central part and circumferential part of the drumhead to prevent the vibration produced during percussion from spreading directly onto the cylinder and to eliminate unnecessary noises so that the drumhead can undertake percussion for a longer time without need to adjust the tuner to increase the tension of the drumhead and it is much easier to tune the drum when necessary.

DETAILED DESCRIPTION

Figure 1:
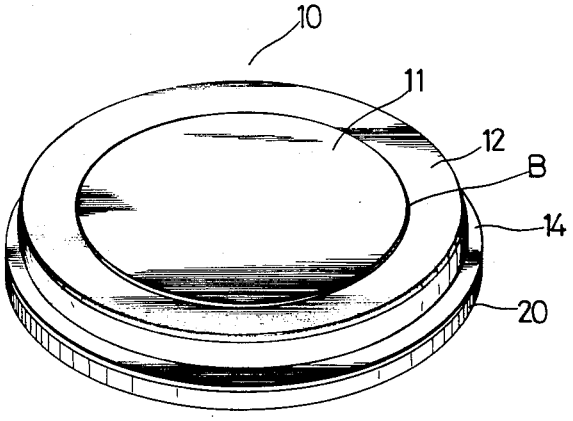
FIG. 1 is a vertical view of the drumhead of this invention.
Figure 2:
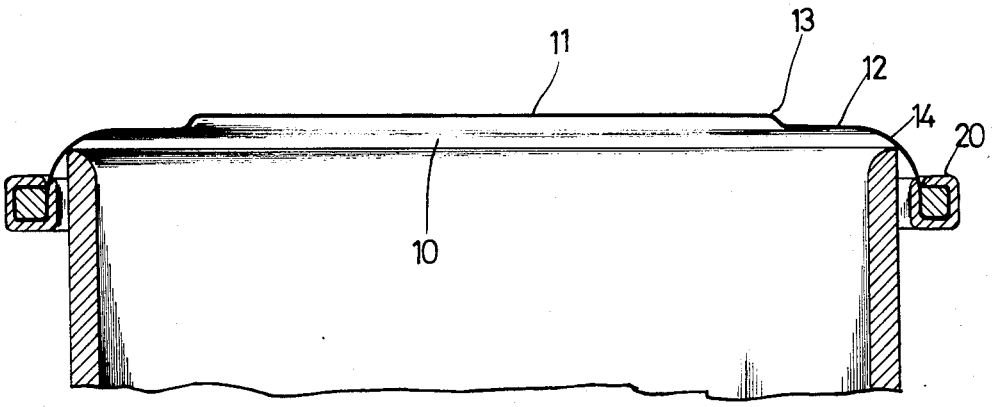
FIG. 2 is a longitudinal section of the drumhead of this invention.

Referring now to the drawings, the nature of this invention is described as follows:

As shown in the figures, the drumhead 10 of this invention comprises a central part 11, circumferential part 12 and stepped buffer ring part 13 of which the edge 14 extends and is attached to the rim 20 of the cylinder. The virtually upstanding buffer ring part 13 is made curved so that when the central part 11 is struck and the vibration stress is transmitted to the buffer ring B, the buffer ring B will work to diminish the radial tension, especially the fatigue-accelerating shock load which is sharp enough to damage the drumhead 10. When the drumhead vibrates up and down, it will be tensed radially. With the buffer ring B about 1–1.2 mm high, the tolerance of the radial tension will be enhanced to minimize the distortion of the drumhead. Thus, the frequency of adjustment can be reduced and the life of the drumhead can be prolonged.

According, the drumhead of this invention having a buffer ring part formed by compression moulding and set between the central part and circumferential part can eliminate the noise produced when the drumhead is stricken, reduce the frequency of adjustment, and prolong the life of the drumhead.

What is claimed is:

1. A jazz drumhead, comprising:

a central part;

a circumferential part; and a stepped and curved buffer ring formed by compression moulding and set between said circumferential part and said central part to make the central part 1–1.2 mm higher than the circumferential part.

* * * * *